US005230185A

United States Patent [19]

Kirschner et al.

[11] Patent Number: 5,230,185

[45] Date of Patent: * Jul. 27, 1993

[54] BLASTING APPARATUS AND METHOD

[75] Inventors: Lawrence Kirschner, Flanders; Michael S. Lajoie, Basking Ridge, both of N.J.; William E. Spears, Jr., Houston, Tex.

[73] Assignee: Church & Dwight Co., Inc., Princeton, N.J.

[ * ] Notice: The portion of the term of this patent subsequent to Jan. 21, 2009 has been disclaimed.

[21] Appl. No.: 794,465

[22] Filed: Nov. 19, 1991

Related U.S. Application Data

[63] Continuation-in-part of Ser. No. 730,514, Jul. 12, 1991, Pat. No. 5,081,799, which is a continuation of Ser. No. 505,918, Apr. 6, 1990, abandoned, and a continuation of Ser. No. 680,337, Apr. 4, 1991, Pat. No. 5,083,402, which is a continuation of Ser. No. 505,918, Apr. 6, 1909, abandoned.

[51] Int. Cl.[5] ..... B24C 3/00

[52] U.S. Cl. ..... 51/410; 51/319; 51/321; 51/436

[58] Field of Search ..... 51/410, 319, 321, 436, 51/427, 438, 320, 321

[56] References Cited

U.S. PATENT DOCUMENTS

| | | | |
|---|---|---|---|
| 2,729,917 | 1/1956 | Gregory | 51/427 |
| 2,913,281 | 11/1959 | LeBlanc, Jr. | 406/146 |
| 3,201,901 | 8/1965 | Pawl | 51/438 |
| 4,075,789 | 2/1978 | Dremann | 51/438 |
| 4,420,957 | 12/1983 | Weber | 51/438 |
| 4,878,320 | 11/1989 | Woodson | 51/436 |

*Primary Examiner*—M. Rachuba
*Attorney, Agent, or Firm*—Cave Bryan

[57] ABSTRACT

A conventional blasting apparatus is modified to provide a separate source of line air to a blast pot through a pressure regulator to provide a greater pressure in the blast pot than is provided to the conveying hose. This differential pressure is maintained by an orifice having a predetermined area situated between the blast pot and the conveying hose. This orifice provides an exit for the blast medium and a relatively small quantity of air from the blast pot to the conveying hose, and ultimately to the nozzle and finally the workpiece. The differential air pressure, typically operating between 1.0 and 15.0 psi with an orifice having an appropriate area, yields acceptable media flow rates in a controlled manner.

41 Claims, 1 Drawing Sheet

BLASTING APPARATUS AND METHOD

This application is a continuation in part which discloses and claims subject matter disclosed in earlier filed pending application Ser. No. 07/730,514, filed Jul. 12, 1991 now U.S. Pat. No. 5,081,799, which is a continuation of application Ser. No. 07/505,918, filed Apr. 6, 1990 and which is now abandoned; and Ser. No. 07/680,337, filed Apr. 4, 1991 now U.S. Pat. No. 5,083,402 which is a continuation of application Ser. No. 07/505,918, filed Apr. 6, 1990 and which is now abandoned.

This invention relates to improved apparatus for directing fine particles in a compressed air stream toward a workpiece and to methods of blasting utilizing such apparatus.

BACKGROUND OF THE INVENTION

Standard sand blasting equipment consists of a pressure vessel or blast pot to hold particles of a blasting medium such as sand, connected to a source of compressed air by means of a hose and having a means of metering the blasting medium from the blast pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 20–30 pounds per minute. About 1.2 pounds of sand are used typically with about 1.0 pound of air, thus yielding a ratio of 1.20.

When it is required to remove coatings such as paint or to clean surfaces such as aluminum, magnesium, plastic composites and the like, less aggressive abrasives, including inorganic salts such as sodium chloride and sodium bicarbonate can be used in conventional sand blasting equipment and are safer than chemical stripping. The medium flow rates required for the less aggressive abrasives is substantially less than that used for sand blasting, and has been determined to be from about 0.5 to about 10.0 pounds per minute, using similar equipment. This requires a much lower medium to air ratio, in the range of about 0.05 to 0.40.

Recent developments have indicated the effectiveness of another stripping media which is also quicker and safer than chemical stripping. This media is a granular media consisting of numerous particles of a plastic material which are also accelerated to high speed and directed against the surface to be cleaned. The media particles can be of various sizes, depending on the application, and can be accelerated to produce a continuous media flow using conventional sand blasting equipment. This system has also been shown to be highly effective in removing paint and other coatings from harder surfaces, such as metal, and also for deburring and other finishing processes and the like. It is far safer than chemical stripping, presents little hazardous waste disposal problems, and greatly reduces the man-hours and expense of surface cleaning. Blast cleaning with plastic media has been shown to be effective on the metal parts of aircraft, as well as suitable for stripping composites.

Here, too, the medium flow rates required for the less aggressive plastic abrasive media is substantially less than that used for sand blasting, and has been determined to be from about 0.5 to about 12.0 pounds per minute, using similar equipment. This, again, requires a much lower medium to air ratio, in the range of about 0.05 to 0.80.

However, difficulties are encountered in maintaining continuous flow at these low flow rates when conventional sand blasting equipment is employed. The fine particles of a medium such as inorganic salts or plastic particles are difficult to convey by pneumatic systems by their very nature. Further, they tend to agglomerate when utilized in apparatus as is typically used in sand blasting. Flow aids such as hydrophobic silica have been added to the bicarbonate in an effort to improve the flow, but a substantially uniform flow of abrasive material to the nozzle has not been possible up till now. Sporadic flow of the blasting media leads to erratic performance, which in turn results in increased cleaning time and even to damage of somewhat delicate surfaces.

Thus it is desired to have a blasting apparatus that can deliver the blast media at a uniform rate that can be controlled in a predictable manner, at flow rates yielding a medium-to-air ratio of between about 0.05 and 0.80 by weight, using a configuration similar to conventional commercially available sand blasting equipment.

SUMMARY OF THE INVENTION

A conventional blasting apparatus is modified to provide a separate source of line air to a blast pot through a pressure regulator to provide a greater pressure in the blast pot than is provided to the conveying hose. This differential pressure is maintained by an orifice having a predetermined area situated between the blast pot and the conveying hose. This orifice provides an exit for the blast medium and a relatively small quantity of air from the blast pot to the conveying hose, and ultimately to the nozzle and finally the workpiece. The differential air pressure, typically operating between 1.0 and 15.0 psi with an orifice having an appropriate area, yields acceptable media flow rates in a controlled manner.

Accordingly, the present invention also provides surface cleaning methods using less aggressive abrasives than sand wherein such abrasives have a mean particle size of from about 50 to 2000 microns. Such abrasives include inorganic salts such as sodium bicarbonate, sodium sulfate and the like, either alone or mixed and, if desired, admixed with small amounts of more aggressive materials to provide desired profiles and patterns. The plastic media contemplated include granular media substantially composed of particles of a plastic material which has a Mohs scale hardness number preferably lower than about 3.5.

DETAILED DESCRIPTION OF THE INVENTION

Figure 1:
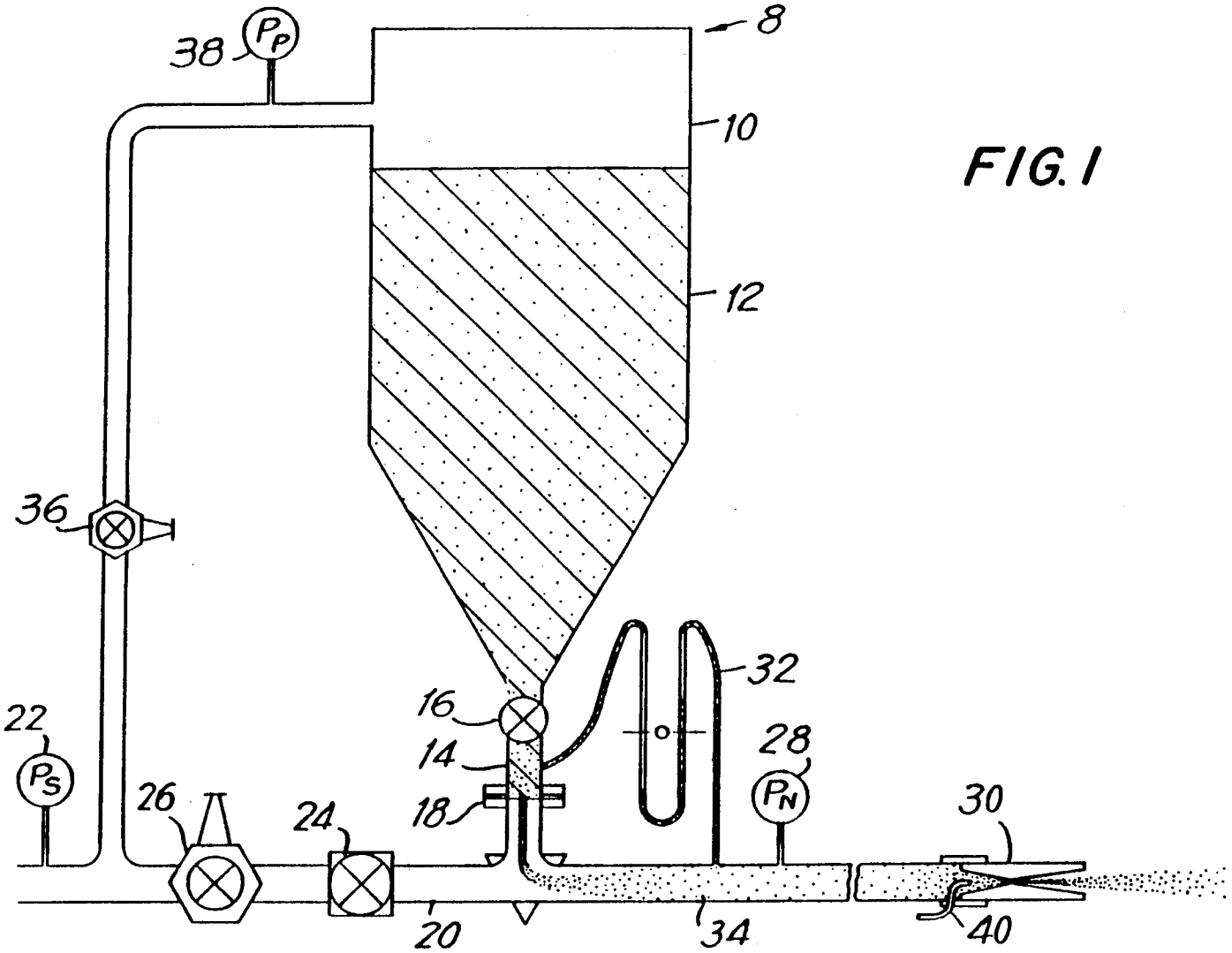
FIG. 1 illustrates a blasting apparatus modified in accordance with the present invention.

In order to feed fine particles of a material such as an inorganic salt, such as a bicarbonate, having a mean particle size of from about 50 to 1500 microns, preferably, from about 250 to 850 microns, or a plastic media having a mean particle size of from about 200 to 2000 microns, preferably, from about 500 to 1000 microns, at a uniform rate, pressures within the blast pot, including the blast hose pressure, must be positive with respect to the nozzle. Pressures are typically in the range of about 20–125 psig and, preferably, about 20–60 psig.

Since the blast pot and the conveying hose operate at about the same pressure, the flow of blast media in conventional sand blasting equipment is controlled by gravity feed and a metering valve. It has been found that the blast pot was under a small differential pressure with respect to the blast delivery hose pressure, which fluctuated between positive and negative; the result was that the flow rates of the blast media fluctuated also in response to the differential pressure changes. Further according to the invention, a differential pressure gauge is installed between the delivery hose and the blast pot to monitor the differential pressure directly. The pressure can be closely controlled by means of a pressure regulator at any hose pressure from 10 to 125 psig or higher, depending on the supply air pressure. The present invention eliminates this source of flow rate variation and also modifies conventional equipment to handle blast media at low flow rates of about 0.5 to 12.0 pounds per minute, preferably up from about 0.5 to 5.0 pounds per minute.

While a preferred blast media is sodium bicarbonate, other blast media such as potassium bicarbonate, ammonium bicarbonate, sodium chloride, sodium sulfate and other water-soluble salts or mixtures thereof, are meant to be included herein. Also included are mixtures of such water-soluble salts with more aggressive materials, such as, aluminum oxide, which is insoluble, especially where precise flow control is necessary.

Another effective media contemplated herein and which has been found to be effective for use on soft substrates such as composites and which avoids surface damage when properly applied, is a plastic media with very specific properties. The media is composed of particles of a material having a Mohs scale hardness number of approximately 2.5 to 4.0. Particle hardness preferably should not exceed a Mohs hardness of about 3.5, as this has been found to damage soft substrates, e.g., composite surfaces. Plastic has been found to be the most suitable material for the media. Urea formaldehyde, thermoplastic or thermoset acrylics, melamine formaldehyde, polyester or other thermoplastic or thermoset plastics can readily be formed into granular particles for this purpose. A Mohs hardness of 3.0 is substantially softer than other blast media, such as sand, which has a Mohs hardness of 7. It is the relative softness of the media, in combination with the method described below, which prevents damage to composite surfaces. A suitable commercially available media which can be used with the present invention is POLYEXTRA® Blast Cleaning Media, manufactured by the U.S. Plastic and Chemical Corporation or SOLIDSTRIP® Blast Media manufactured by E. I. duPont de Nemours & Co. (Inc.).

Plastic blast media are generally classified as to particle size by U.S. standard sieve sizes. While it is not believed to be critical, media with a sieve size of 20–30 i.e., about 600 to 850 microns, is known to be suitable for use with the present invention. It is anticipated that media having sieve sizes ranging from 12–16 to 60–80, i.e., about 200 to about 2000 microns, can be used, with the selection of the size being based on the particular application.

Referring to FIG. 1, blast apparatus 8 includes a blast pot 10, partially filled with blast media 12. The blast pot 10, suitably having a cavity of about 6 cubic feet, terminates in a media exit line 14 governed by a valve 16. The medium control area, typically but not limited to an orifice plate 18, further restricts the flow of the media 12 to the desired flow rate. A line 20 is connected to a source or pressurized air (not shown) which is monitored with an inlet of monitor 22. Air valve 24 is a remotely operated on/off valve that activates the air flow to the nozzle and the opening and closing of the media cut off valve. Nozzle pressure regulator valve 26 regulates the nozzle pressure by means of a monitor 28 when the system is in operation. Nozzle pressure regulator valve 26 can maintain the desired nozzle pressure. The nozzle pressure monitor 28 enables a controlled pressure to be applied to the nozzle 30, suitably having a throat diameter of about 0.5 inch. The differential pressure gauge 32 monitors the pressure between the blast pot 10 and the conveying hose 34. The pot pressure regulator 36, measured by gauge 38, is used to provide a pressure higher than the pressure in the conveying hose 34, thus allowing the differential pressure to be monitored by differential pressure gauge 32. When necessary optional equipment for protection of and cooling of the workpiece and the control of dust is provided by a water injection line 40, which injects water to the nozzle 30.

In operation, the blast media 12 is fed through media exit line 14 and the valve 16 to an orifice 18, which regulates the flow of media to the compressed air line 20. The orifice openings can vary from about 0.063 to about 0.875 inch diameter, or openings corresponding to the area provided by circular orifices of 0.063 to 0.875 inch diameter depending on the media employed.

When using a plastic media the openings correspond to about a 0.50 inch opening for media having a mean particle size of about 2.50 to 420 microns, and 0.875 inch opening for a media having a mean particle size from about 600 to 850 microns. A positive pressure of between about 1 to 15 psig, preferably about 1 to 5 psig, between the media exit line 14 and the conveying hose 34 is maintained at all times. A source of compressed air is also fed to the air line 20, regulated by the valves 24 and 26 to the desired air pressure and nozzle pressure, respectively, which preferably is between about 15 to about 125 psig. The pot pressure regulator 36 controls the pressure to the top of the blast pot 10, further ensuring a controlled and uniform flow of blast media 12. The manometer or other differential pressure gauge 32 measures the differential pressure, which is proportional to the amount of media flowing through orifice 18. The blast media, compressed air and water are delivered to the nozzle 30 and ejected toward the workpiece (not shown) at a uniform and controllable rate.

A stream of sodium bicarbonate media at a pressure of 64 psig and feed rate of about 2 pounds per minute, nozzle pressures of psig and water pressure of 200 psi, was directed at painted aluminum panels 2 feet by 2 feet by 0.032 inch thick situate 18 inches from the orifice of the nozzle. The panels were depainted and all corrosion products removed in four minutes, with no damage to the aluminum panels.

A stream of plastic composite media (POLYEXTRA Blast Cleaning media) having a mean particle size of 500 microns, at a pressure of 40 psig and feed rate of about 10 pounds per minute, nozzle pressure 40 psi, was directed at aluminum panels 2 feet by 2 feet by 0.032 inch thick situated 12 inches from the orifice of the nozzle. The panels were depainted removed in 1.6 minutes, with no damage to the aluminum panels.

The present apparatus removed paint and other coatings efficiently and effectively from the surface of delicate metal parts, including areas around seams, rivets, screws, and the like, as well as from articles fabricated from soft substrates such as composite materials that heretofore required separate, special techniques. The system can be used efficiently and controllably with robotics.

It will be understood that the specific parameters of the preferred embodiments described hereinabove may be varied without departing from the scope of this invention. Accordingly, the preceding description should be construed as illustrative and not in a limiting sense.

What is claimed is:

1. In a blasting apparatus for delivering a blasting medium comprising fine particles having a mean particle size of from about 50 to 2000 microns, including:

a pressure vessel containing said blasting medium;

a source of compressed air for entraining the blasting medium, in fluid communication with the pressure vessel;

a conveying line, in fluid communication with the source of compressed air and with the pressure vessel and wherein the blasting medium and a stream of compressed air are mixed;

a nozzle connected to the conveying line and through which the mixture of compressed air and blasting medium are discharged;

an air line connecting the conveying line and the pressure vessel to the source of compressed air; and an exit line connecting the pressure vessel to the conveying line;

the improvement comprising:

a variable size orifice positioned within said exit line being adjustable to predetermined opening areas which restrict the flow of the blasting medium to regulate the flow rate consistent with the particle size of said blasting medium;

sensor means connected to the exit line and to the conveying line, for monitoring the pressure differential therebetween;

pressure regulator means responsive to said sensor means, wherein said pressure regulator means includes separate pressure vessel pressure regulator means in connection with the air line and conveying line pressure regulator means in connection with the conveying line, for regulating pressure within the pressure vessel and the conveying line and for maintaining a positive, preselected pressure differential between the pressure vessel and the conveying line.

2. The blasting apparatus of claim 1, wherein said preselected pressure differential is between 1.0 and 5.0 psi.

3. The blasting apparatus of claim 2, wherein said preselected pressure differential is between 1.0 and 5.0 psi.

4. The blasting apparatus of claim 1, wherein said preselected pressure differential is selected to maintain a uniform flow rate of blasting medium.

5. The blasting apparatus of claim 4, wherein said uniform flow rate is between about 0.5 and 12 pounds per minute of blasting medium.

6. The blasting apparatus of claim 1 wherein the sensor means monitors the pressure vessel at the exit line in connection therewith.

7. The blasting apparatus of claim 1 wherein the blasting medium has a mean particle size of from about 50 to 1500 microns.

8. The blasting apparatus of claim 7 wherein the blasting medium is a water soluble salt or a mixture of water soluble salts.

9. The blasting apparatus of claim 8 wherein the water soluble salt is sodium bicarbonate.

10. The blasting apparatus of claim 8 wherein the water soluble salt is sodium sulfate.

11. The blasting apparatus of claim 8 wherein the water soluble salt is mixed with a more aggressive blasting medium.

12. The blasting apparatus of claim 1 wherein the blasting medium has a mean particle size of from about 200 to 2000 microns.

13. The blasting apparatus of claim 12 wherein the blasting medium is a plastic medium having a Mohs hardness of less than about 3.5.

14. The blasting apparatus of claim 1 wherein said orifice positioned within said exit line has an opening corresponding to the area provided by circular orifices of from about 0.063 to 0.875 inch diameter.

15. The blasting apparatus of claim 14 wherein said orifice has an opening corresponding to about a 0.50 inch opening and the blasting medium has a mean particle size of about 250 to 420 microns.

16. The blasting apparatus of claim 14 wherein said orifice has an opening corresponding to about a 0.875 inch opening and the blasting medium has a mean particle size from about 600 to 850 microns.

17. A method for blasting, comprising the steps of:

containing a quantity of blasting medium comprised of fine particles having a mean particle size of from about 50 to 2000 microns within a pressure vessel;

pressurizing said pressure vessel by providing fluid communication between said pressure vessel and a source of pressurized air;

feeding said blasting medium from said pressure vessel, through an exit line to a conveying line, said conveying line being in fluid communication with said source of pressurized air through an air line;

passing said blasting medium through a variable size orifice opening positioned in said exit line, said orifice opening being adjustable to predetermined areas which restrict the flow of said blasting medium to regulate the flow rate consistent with the particle size of said blasting medium;

mixing said blasting medium with the stream of pressurized air flowing within said conveying line;

sensing the pressure in said pressure vessel and said conveying line;

regulating the pressure in said air line and in said conveying line to maintain a pressure differential at a preselected level such that the pressure level within said pressure vessel is greater than the pressure within said conveying line;

discharging said mixture of blasting medium and said stream of pressurized air through a nozzle at the end of said conveying line.

18. The blasting method of claim 14 wherein the blasting medium has a mean particle size of from about 50 to 1500 microns.

19. The blasting method of claim 18 wherein the blasting medium is a water soluble salt or a mixture of water soluble salts.

20. The blasting method of claim 19, wherein the blasting medium is sodium bicarbonate.

21. The blasting method of claim 19 wherein the water soluble is sodium sulfate.

22. The blasting method of claim 19 wherein the water soluble salt is mixed with a more aggressive blasting medium.

23. The blasting method of claim 17 wherein the blasting medium has a mean particle size of from about 200 to 2000 microns.

24. The blasting method for claim 23, wherein the blasting medium is a plastic medium having a Mohs hardness of less than about 3.5.

25. The blasting method of claim 17, wherein said preselected pressure differential is between 1.0 and 15.0 psi.

26. The blasting method of claim 25, wherein said preselected pressure differential is between 1.0 and 5.0 psi.

27. The blasting method of claim 17, wherein said preselected pressure differential is selected to maintain a uniform flow rate of blasting medium.

28. A method for blasting, comprising the steps of:

containing a quantity of blasting medium comprised of fine particles having a mean particle size of from about 50 to 2000 microns within a pressure vessel;

pressuring said pressure vessel by providing fluid communication between said pressure vessel and a source of pressurized air;

feeding said blasting medium from said pressure vessel, through an exit line to a conveying line, said conveying line being in fluid communication with said source of pressurized air through an air line;

restricting the flow of said blasting medium to said conveying line at a flow rate of from about 0.5 to 12 pounds per minute through an orifice having a predetermined area and which is situated in said exit line;

mixing said blasting medium with the stream of pressurized air flowing within said conveying line;

sensing the pressure in said pressure vessel and said conveying line;

controlling the pressure in said air line and in said conveying line to provide a pressure differential such that the pressure level within said pressure vessel is greater than the pressure within said conveying line;

regulating said pressure differential in proportion to the flow of blasting medium through said orifice to provide a blasting medium-to-air ratio in the conveying line of between about 0.05 and 0.80 by weight; and discharging said mixture of blasting medium and said stream of pressurized air through a nozzle at the end of said conveying line.

29. The method of claim 28 wherein the blasting medium has a mean particle size of from about 50 to 1500 microns.

30. The method of claim 29 wherein the blasting medium is a water soluble salt or a mixture of water soluble salts.

31. The method of claim 30 wherein the water soluble salt is sodium bicarbonate.

32. The method of claim 30 wherein the water soluble salt is sodium sulfate.

33. The method of claim 30 wherein the water soluble salt is mixed with a more aggressive blasting medium.

34. The method of claim 28 wherein the blasting medium has a mean particle size of from about 200 to 2000 microns.

35. The method of claim 34 wherein the blasting medium is a plastic medium having a Mohs hardness of less than about 3.5.

36. The method of claim 28 wherein the pressurized air pressure is between about 20 to 125 psig.

37. The method of claim 28 wherein the pressure differential is between about 1.0 and 15.0 psi.

38. The method of claim 37 wherein the pressure differential is between about 1.0 and 5.0 psi.

39. The method of claim 36 wherein the flow rate of blasting medium through the orifice is between about 0.5 to 12.0 pounds per minute.

40. The method of claim 28 wherein the orifice has an opening corresponding to the area provided by circular orifices of about 0.063 to 0.875 inch diameter.

41. The method of claim 40 wherein the orifice is circular.

* * * * *